US008798789B2

(12) United States Patent
Horev et al.

(10) Patent No.: US 8,798,789 B2
(45) Date of Patent: Aug. 5, 2014

(54) METHOD AND APPARATUS FOR DISPENSING ITEMS

(75) Inventors: Noam Horev, Jerusalem (IL); Zvi Weinberger, Jerusalem (IL)

(73) Assignee: Data Detection Technologies Ltd., Jerusalem (IL)

( * ) Notice: Subject to any disclaimer, the term of this patent is extended or adjusted under 35 U.S.C. 154(b) by 0 days.

(21) Appl. No.: 13/642,964

(22) PCT Filed: May 12, 2011

(86) PCT No.: PCT/IL2011/000383

§ 371 (c)(1),
(2), (4) Date: Oct. 23, 2012

(87) PCT Pub. No.: WO2011/141919

PCT Pub. Date: Nov. 17, 2011

(65) Prior Publication Data

US 2013/0054017 A1 Feb. 28, 2013

Related U.S. Application Data

(63) Continuation-in-part of application No. 12/800,349, filed on May 13, 2010, now Pat. No. 8,417,375.

(51) Int. Cl.
*A61J 1/03* (2006.01)

(52) U.S. Cl.
USPC ..... 700/236; 221/2; 221/7

(58) Field of Classification Search
USPC ..... 221/2, 7; 700/236; 377/10
See application file for complete search history.

(56) References Cited

U.S. PATENT DOCUMENTS

| | | | | |
|---|---|---|---|---|
| 2,632,588 | A | 3/1953 | Hoar | |
| 4,382,527 | A | 5/1983 | Lerner | |
| 4,843,579 | A | 6/1989 | Andrews et al. | |
| 5,110,008 | A * | 5/1992 | Moulding et al. | 221/15 |
| 5,317,645 | A | 5/1994 | Prozek et al. | |

(Continued)

FOREIGN PATENT DOCUMENTS

| | | |
|---|---|---|
| DE | 20214431 | 3/2004 |
| DE | 102009052292 B3 | 4/2011 |

(Continued)

OTHER PUBLICATIONS

UK Search & Examination Report regarding GB112069.9, mailed on Mar. 28, 2012—5 pages.

(Continued)

*Primary Examiner* — Timothy Waggoner
(74) *Attorney, Agent, or Firm* — Roach Brown McCarthy & Gruber, P.C.; Kevin D. McCarthy

(57) ABSTRACT

An apparatus for dispensing discrete items into a multiplicity of containers such that each of the multiplicity of containers contains at least a predetermined number of items, the apparatus comprising: a conveyor for transporting items from a feeder to a location from which the items fall into the container; a counting mechanism for counting a number of items that have fallen off the conveyor into the container during operation of the conveyor and due to inertial forces after the operation; an actuator for operating or stopping the conveyor in accordance with control commands; and a computing platform for receiving a count from the counting mechanism and generating the control commands to be provided to the actuator.

29 Claims, 4 Drawing Sheets

(56) References Cited

U.S. PATENT DOCUMENTS

| | | | | |
|---|---|---|---|---|
| 5,444,749 | A | 8/1995 | Nambu | |
| 5,473,703 | A * | 12/1995 | Smith | 221/200 |
| 5,768,327 | A * | 6/1998 | Pinto et al. | 377/10 |
| 5,884,806 | A * | 3/1999 | Boyer et al. | 221/75 |
| 6,253,953 | B1 | 7/2001 | Ishizuka | |
| 6,449,927 | B2 | 9/2002 | Hebron et al. | |
| 6,631,826 | B2 | 10/2003 | Pollard et al. | |
| 6,659,304 | B2 | 12/2003 | Geltser et al. | |
| 7,269,476 | B2 * | 9/2007 | Ratnakar | 700/236 |
| 7,795,556 | B1 * | 9/2010 | Dean | 221/206 |
| 7,930,064 | B2 * | 4/2011 | Popovich et al. | 221/9 |
| 2003/0222091 | A1 | 12/2003 | Gerold et al. | |
| 2004/0154688 | A1 | 8/2004 | Geltser et al. | |
| 2005/0263537 | A1 | 12/2005 | Gerold et al. | |
| 2008/0173649 | A1 | 7/2008 | Sus et al. | |
| 2009/0177316 | A1 | 7/2009 | Schedel et al. | |
| 2010/0205002 | A1 | 8/2010 | Chambers | |

FOREIGN PATENT DOCUMENTS

| | | |
|---|---|---|
| EP | 1083007 | 3/2001 |
| EP | 759815 | 10/2002 |
| EP | 1852372 | 11/2007 |
| JP | 2132011 | 5/1990 |
| WO | 2011054974 A1 | 5/2011 |

OTHER PUBLICATIONS

International Search Report for PCT/IL2011/000383, mailed on Nov. 9, 2011—3 pages.

http://www.youtube.com/watch?feature=player_embedded&v=BhHCkeLs0OU, image of video at around 17 seconds, titled "Counting machine for frozen food"; provider of video appears to be Koshinsha, according to You Tube the video was published on Mar. 2, 2012.

http://www.youtube.com/watch?feature=player_embedded&v=bEKsrY5SIMw, image of video at around 11 second, not titled; according to You Tube, provider of video appears to be Koshinsha, according to You Tube the video was published on Mar. 2, 2012.

http://www.youtube.com/watch?v=pKJSusmPusM&list=UUH-lhqel1SpJW4YOZeRR9mQ&index=1, image at around 2 minutes, 54 seconds, titled "Counting machine for molded parts", provider of video appears to be Koshinsha, according to You Tube the video was published on Nov. 22, 2012.

http://www.youtube.com/watch?v=Gh0siDEt4Qc&list=UUH-lhqel1SpJW4YOZeRR9mQ&index=11, image at around 30 seconds, not titled; according to You Tube, provider of video appears to be Koshinsha, according to You Tube the video was published on Feb. 3, 2012.

http://www.youtube.com/watch?v=y668e23Flf8&list=UUH-lhqel1SpJW4YOZeRR9mQ&index=20, image at around 4 seconds, not titled; according to You Tube, provider of video appears to be Koshinsha, according to You Tube the video was uploaded on Oct. 25, 2010.

http://www.youtube.com/watch?v=myECsaLgRLc&list=UUH-lhqel1SpJW4YOZeRR9mQ&index=22, image at around 7 seconds, titled "Digital Area Counter"; according to You Tube, provider of video appears to be Koshinsha, according to You Tube the video was uploaded on Sep. 3, 2010.

http://www.youtube.com/watch?v=OyEH4GL0alU&list=UUH-lhqel1SpJW4YOZeRR9mQ&index=26, image at around 4 seconds, titled Digital Area Counter; according to You Tube, provider of video appears to be Koshinsha, according to You Tube the video was uploaded on Nov. 18, 2009.

http://www.youtube.com/watch?v=6ymjnuX4bG4&list=UUH-lhqel1SpJW4YOZeRR9mQ&index=25, image at around 17 seconds, titled Digital Area Counter; according to You Tube, provider of video appears to be Koshinsha, according to You Tube the video was uploaded on Jan. 6, 2010.

http://www.koshinsha.jp/calculation/index.html—print out of website on Mar. 6, 2013.

http://www.koshinsha.jp/calculation/digital_acounter.html—print out of website on Mar. 6, 2013.

* cited by examiner

METHOD AND APPARATUS FOR DISPENSING ITEMS

FIELD OF THE INVENTION

The present invention relates to an apparatus and method for dispensing a multiplicity of discrete items into groups (or "batches"), each group containing a predetermined number of the items.

BACKGROUND OF THE INVENTION

It is frequently required to dispense items of particulate matter into batches of known quantity. Examples include dispensing candies, seeds or medicinal pills into bottles, sachets or other containers, sorting rough diamonds into packages or containers of approximately equal number of samples, such as to enable different evaluators to estimate the quality and worth of the whole, or the like.

In some dispensing tasks, the finished container must not contain less than the predetermined number of items. For example, when dispensing certain pills, a full treatment cycle may have to be provided, therefore at least the predetermined number of items must be provided in each container.

On the other hand, the dispensed items may be expensive, so if too many of the containers contain more than the predetermined number of items, it translates to direct loss to the supplier of the items or to the packing organization.

In many dispensing machines, the items are transported along a conveyor, at the end of which they fall or are otherwise collected into containers. Thus, if the items are put onto the conveyor in a single file, then a simple counting or weighting mechanism may provide satisfactory results. However, such a mechanism is inherently slower and therefore enables the dispensing of fewer items than if the items were freely placed on the conveyor without posing such limitations.

Furthermore, some dispensing machines also utilize various barriers for physically preventing items from falling off the conveyor once the desired amount has been reached.

U.S. Pat. No. 5,473,703 to Smith, entitled "Methods and apparatus for controlling the feed rate of a discrete object sorter/counter", discloses a controller which adjusts the vibrator to oscillate the feed bowl at a predetermined amplitude until the sensor array senses a first object. The controller then adjusts the vibrator to oscillate the feed bowl at a lower amplitude and monitors the sensing of other objects. Time intervals between objects being sensed are monitored and the controller adjusts the vibrator to oscillate the feed bowl at a lower or higher amplitude to maintain a constant feed rate. A count of objects sensed is maintained and compared to a predetermined maximum count. When the count of objects equals a predetermined number less than the maximum count, the controller adjusts the vibrator to oscillate the feed bowl at a lower amplitude to lower the feed rate. When the count of objects equals the maximum count, the controller activates a gate closing the chute.

U.S. Pat. No. 6,659,304 to Geltser et al., entitled "Cassettes for systems which feed, count and dispense discrete objects", discloses a high capacity cassette for an object counting and dispensing system, that includes, inter alia, a structure which feeds the discrete objects in single file toward an exit hole.

U.S. Pat. No. 6,449,927 to Hebron et al., entitled "Integrated automated drug dispenser method and apparatus", discloses, inter alia, singulation control, which is a process by which drugs move through a canister in a nearly single-file fashion. Means for singulation control is provided by the width of the acceleration ramp and the dispensing ramp. By providing the proper ramp width, the movement of drugs in other than a nearly single-file fashion is prevented. The proper ramp width may in fact be more than one width and may, for example, be a width that is tapered from a largest width to a smallest width. It may also be preferable to design canisters for specific drugs based on the drug size and shape. The drug size and shape may be used to select a proper ramp width. Singulation control may be aided by maintaining the acceleration ramp and the dispensing ramp surfaces on which drugs move at an angle with respect to horizontal. The angle is selected so that the edge of the ramp surface closest to the center of the canister is above a horizontal plane which intersects the edge of the ramp surface farthest from the center of the canister.

Hebron further discloses that in order to minimize the fill time, the drive frequency is increased slowly until it approaches the maximum detection rate of the sensor. The drug count is a discrete integer count registered in a fixed sampling time. A moving average is used as the basis to predict when the last drug will fall through the sensor. As the drug count approaches the total count, the time to terminate the fill is predicted as a fraction of the sampling time of the counting mechanism. The vibration of the canister or unit-of-use bin by the vibrating dispenser is terminated when the estimated time to terminate is reached. In the expected event that the count is short one or two solid drugs, the drive mechanism is restarted as the last used frequency for a short time pulse, 25 milliseconds to 100 milliseconds, for example. Then the drive mechanism is turned off at least until the next drug count registers. If the count is still short, this process is repeated.

European Patent Application No. 1,852,372 to Ogawa et al., entitled "Vibrating bowl, vibrating bowl feeder, and vacuum deposition apparatus", discloses, inter alia, a vibrating bowl and the like, which are capable of accurately counting the number of objects to be fed, accurately leading objects one by one to an external place per unit time, and aligning collectivity of objects into a row or tier at an intermediate point on a feed passage by simple alignment means.

U.S. Patent Application Publication No. 2003/022291 2005/0263537 to Gerold et al., entitled "Authomated pill-dispensing apparatus", discloses, inter alia, a bulk storage unit useful for automatically dispensing solid pills includes a track having a length, an upstream end and a downstream end, the track being adapted to feed pills along its length in a longitudinal direction when the track is vibrated. A storage unit includes a hopper positioned over the track and having an opening for dropping pills onto the upstream end, the storage unit including a door movable between an open position permitting singulated pills to drop off the downstream end and a closed position preventing pills from dropping off the track. The door, when close to the closed position and being moved to the closed position, moving parallel the longitudinal direction so that any pills handing partially off the downstream end are pushed back onto the track as the door comes to rest in the closed position.

U.S. Patent Application Publication No. 2010/0205002 to Chambers, entitled "Automated pill-dispensing apparatus", discloses, inter alia, that pills advance up a spiraling edge of a vibratory feeding bowl and pass through a singulator. Proceeding in a generally single file manner, each pill falls one by one off an exit edge of the vibratory feeding bowl into an upper portion of a pill dispensing route. As the pills pass through the upper portion, they also pass through the light beams provided by a first and second sensor pairs. Then the pills continue down through a lower portion of the dispensing route, usually a dispensing chute. After passing through the dispensing chute, the pills pass through a dispensing neck and out of the pill dispensing device and into the pill bottle. Once the desired number of pills has been dispensed, the controller signals the vibratory base unit to turn off. Moreover, a pill stop mechanism is activated by the controller to prevent any additional pills located close to the exit edge from falling into the upper portion of the dispensing route.

U.S. Pat. No. 6,253,953 to Ishizuka, entitled "Automatic high-speed pill counting apparatus", discloses, inter alia, an apparatus comprising a cylindrical pill hopper having a pill exit and a center hole in a base plate; a rotational separative feeder mounted in the cylindrical pill hopper and removably fitted on a shaft borne in the center hole of the base plate, the feeder including an upper diametrically smaller portion and a lower diametrically larger portion having an external diameter approximate to the internal diameter of the lower portion of the pill hopper, a multiplicity of vertically through holes being formed in the outer circumference of the lower diametrically larger portion and allowed to come into alignment with the pill exit for accommodating a plurality of pills vertically, the multiple vertically through holes being enlarged at their lower portions, a ring-shaped slit being formed in such a position in the outer circumference of the lower diametrically larger portion as to accommodate substantially one pill from the bottom; and a pill separating plate mounted on the cylindrical pill hopper above the pill exit and having an inwardly projected tip fitted loosely in the slit. The apparatus can count the pills quickly and accurately while preventing the inner wall of the cylindrical portion of the hopper from becoming dirty and the pills from being soiled or broken.

U.S. Pat. No. 4,382,527 to Lerner, entitled "Article handling system with dispenser", discloses, inter alia, that in a system for dispensing weighed or counted articles, articles are fed from a supply hopper by a vibratory conveyor to maintain a controlled level of articles in a bowl-shaped feeder hopper. In a weigher embodiment, articles are initially discharged from the feeder hopper through two discharge openings into an accumulator bucket. A weighing unit monitors the weight of articles in the bucket and signals a door to close one of the discharge openings as the weight of articles in the bucket begins to approach a predetermined weight. The weighing unit subsequently signals the feeder hopper drive to slow its feeding action as the weight of articles in the bucket more closely approaches the predetermined weight. The feeder hopper discharge openings are arranged near each other at locations where the door-controlled opening will provide a rapid, bulk feed of articles, while the other opening will provide a single-file trickle feed. In a counter embodiment, a feeder hopper having a single discharge opening is used so that articles can pass single file from the feeder hopper past a counter unit to an accumulator bucket.

Japanese Patent No. 2,132,011 to Kazumi et al., entitled "Granular material discharging device", discloses, in its published English abstract, improvement of the discharge control precision by selecting the vibration frequency in response to the load change or a feeder based on the measured data of the load and flow speed for each vibration frequency so that the flow speed is made constant in a medicine quantitative discharging device using a vibration feeder. The device includes a central processing unit which selects the relational data among the vibration frequency, load, and flow speed in response to the type of an inputted bulk material, e.g., D1. The optimum frequency corresponding to the present load is selected from the data D1 based on the load signal SL outputted from a weight measuring device, and the AC power source corresponding to the frequency signal is fed to an electromagnetic section via a D/A converting circuit, an integrating circuit, a V/F converting circuit, and a power driving circuit; A vibration feeder is operated at the preset frequency, and the flow speed is made nearly constant. The discharge control precision can be improved according to this constitution.

Some dispensing and packing machines include a counting mechanism for determining the actual number of collected objects. By monitoring objects interrupting the illumination of a light source onto a pixelated array, it is possible to count objects being poured.

Such a mechanism is disclosed, for example, in U.S. Pat. No. 5,768,327 to Pinto et al., entitled "Method and apparatus for optically counting discrete objects". Pinto describes an object counter including a feeding funnel having a frustroconical section, the narrow end of which is coupled to a substantially vertical feeding channel having a substantially rectangular cross section. A pair of linear optical sensor arrays are arranged along adjacent orthogonal sides of the feeding channel and a corresponding pair of collimated light sources are arranged along the opposite adjacent sides of the feeding channel such that each sensor in each array receives light the corresponding light source. Objects which are placed in the feeding funnel fall into the feeding channel and cast shadows on sensors within the arrays as they pass through the feeding channel. Outputs from each of the two linear optical arrays are processed separately, preferably according to various conservative criteria, and two object counts are thereby obtained. The higher of the two conservative counts is accepted as the accurate count and is displayed on a numeric display. In another embodiment, four sensor arrays and light sources are provided. The third and fourth sensor arrays and corresponding light sources are located downstream of the first and second arrays. The outputs of each of the sensor arrays are processed separately and the highest conservative count is accepted as the accurate count and is displayed on a numeric display.

European Patent No. 1,083,007 to Satoru at al., entitled "Method and apparatus for sorting granular objects with at least two different threshold levels", discloses, inter alia, a method and system for sorting items in different sizes, wherein granular objects flowing in a continuous form are irradiated by light. The resulting image element signals from a solid-state image device are binarized by a threshold value of a predetermined luminance brightness determined for detecting a defective portion of a granular object of a first level, and the above image element signals are also binarized by a threshold value of a predetermined luminance brightness determined for detecting a defective portion of a second level. The second level is for a tone of color heavier than that of the first level. When a defective image element signal is detected from the binarized image elements, an image element of a defective granular object at the center location is specified and the sorting signal is outputted to act on the center location of the defective granular object corresponding to the image element at the specified center location. A granular object having a heavily colored portion which, even small in size, has influence to the product value can be effectively ejected. Sorting yield is improved by not sorting out the granular objects having a defective portion which is small and only lightly colored thus having no influence to the product value.

There is thus a need in the art for a dispensing apparatus and method, which provide for dispensing a predetermined quantity of items in each group, in an accurate, rapid and efficient manner.

SUMMARY OF THE INVENTION

There is provided, in accordance with an embodiment, a method for dispensing discrete items into a multiplicity of containers such that each of the multiplicity of containers contains a predetermined number of items, the method comprising: operating a conveyor such that items placed on the conveyor fall into a container at least partially in parallel, the conveyor activated for a period of time such that less than the predetermined number of items fall into the container; determining a number of missing items in the container after items have fallen into the container during the operation and due to inertial forces after the operation; and operating the conveyor for a pulse duration.

In some embodiments, the method further comprises an earlier calibration stage in which the period of time over which the conveyor is activated is determined in accordance with a first function.

In some embodiments, the method further comprises updating, on the fly, a parameter associated with the first function of the calibration stage.

In some embodiments the method further comprises determining the pulse in accordance with a second function.

In some embodiments, the method further comprises updating, on the fly, a parameter associated with the second function of the calibration stage.

In some embodiments of the method, the conveyor operates with constant characteristics.

In some embodiments of the method, the characteristics are selected from the group consisting of: speed, vibration frequency, vibration amplitude and inclination. In some embodiments the method further comprises determining the pulse duration such that the missing items will fall during the pulse duration or due to inertial forces acting after the pulse duration.

In some embodiments of the method, the conveyor transports the items in a first direction and wherein two or more items are placed on the conveyor such that the items at least partially overlap in a direction orthogonal to the first direction.

In some embodiments of the method, the items are counted using a system comprising one or more electromagnetic energy sources and one or more sensors for receiving the electromagnetic energy.

In some embodiments of the method, the items are counted using a system comprising three or more electromagnetic energy sources and three or more sensors wherein two or more of the electromagnetic energy sources emit electromagnetic energy in non-perpendicular directions.

There is further provided, in accordance with an embodiment, an apparatus for dispensing discrete items into a multiplicity of containers such that each of the multiplicity of containers contains a predetermined number of items, the apparatus comprising: a conveyor for transporting items from a feeder to a location from which the items fall into the container; a counting mechanism for counting a number of items that have fallen off the conveyor into the container during operation of the conveyor and due to inertial forces after the operation; an actuator for operating or stopping the conveyor in accordance with control commands; and a computing platform for receiving a count from the counting mechanism and generating the control commands to be provided to the actuator, the computing platform executing a control component configured to: generate a first command to the actuator to operate the conveyor for an operation duration, such that less than a required number of items will fall off the conveyor into the container during the operation and due to inertial forces after the operation, determine a number of missing items in the container after items have fallen into the container during the operation and due to inertial forces after the operation, and generate a second command to the actuator to operate the conveyor for a pulse operation duration.

In some embodiments of the apparatus, the control component is further configured to determining the pulse operation duration such that the missing items will fall during the pulse operation duration or due to inertial forces acting after the pulse operation duration.

In some embodiments of the apparatus, the first command is configured to cause the conveyor to operate with constant characteristics.

In some embodiments of the apparatus, the characteristics are selected from the group consisting of: speed, vibration frequency, vibration amplitude and inclination. In some embodiments of the apparatus, the operation duration is determined in accordance with a first function.

In some embodiments of the apparatus, the pulse operation duration is determined in accordance with a second function. In some embodiments of the apparatus, the conveyor is configured to transport the items in a first direction and two or more items are placed on the conveyor such that the items at least partially overlap in a direction orthogonal to the first direction. In some embodiments of the apparatus, the counting mechanism comprises one or more electromagnetic energy sources and one or more sensors for receiving the electromagnetic energy.

In some embodiments the apparatus further comprises three or more electromagnetic energy sources and three or more sensors, wherein two or more of the electromagnetic energy sources emit electromagnetic energy in non-perpendicular directions.

There is further provided, in accordance with an embodiment, an item dispenser comprising: a parallel transport conveyor; a counting mechanism positioned below an end of said conveyor, for counting items falling off said conveyor, wherein at least some of the items are at least partially horizontally parallel when falling through said counting mechanism; and a computing platform connected to said conveyor and to said counting mechanism, and being configured to operate said conveyor in a continuous mode until a desired item count of a present batch is indicated by said counting mechanism as nearly being reached, and in a pulsed mode to complete at least an amount of items missing from the desired item count, wherein the pulsed mode comprises activation of said conveyor in one or more pulses having a length which was pre-determined to cause a set number of items to fall off the conveyor as a direct result of the conveyor's operation as well as indirectly, due to inertial forces following the pulse.

In some embodiments of the item dispenser, said computing platform is further configured to pre-determine, in a calibration stage preceding an item dispensing task, at least one of the pulse length and a length of the continuous operation mode.

In some embodiments of the item dispenser, said computing platform is further configured to adjust, during a dispensing task comprising dispensing of multiple batches, at least one of the pulse length and a length of the continuous operation mode, so as to enhance accuracy in matching the desired item count in subsequent batches.

There is further provided, in accordance with an embodiment, a computer program product comprising: a non-transitory computer readable medium; a first program instruction for generating a first command for an actuator to operate a conveyor for an operation duration, such that less than a required number of items will fall off the conveyor into a container during the operation and due to inertial forces after the operation; a second program instruction for determining a number of missing items in the container after items have fallen into the container during the operation and due to inertial forces after the operation; and a third program instruction for generating a second command for the actuator to operate the conveyor for a pulse operation duration, wherein said first, second and third program instructions are stored on said non-transitory computer readable medium.

BRIEF DESCRIPTION OF THE FIGURES

Exemplary embodiments are illustrated in referenced figures. Dimensions of components and features shown in the figures are generally chosen for convenience and clarity of presentation and are not necessarily shown to scale. The figures are listed below.

DETAILED DESCRIPTION

Figure 1:
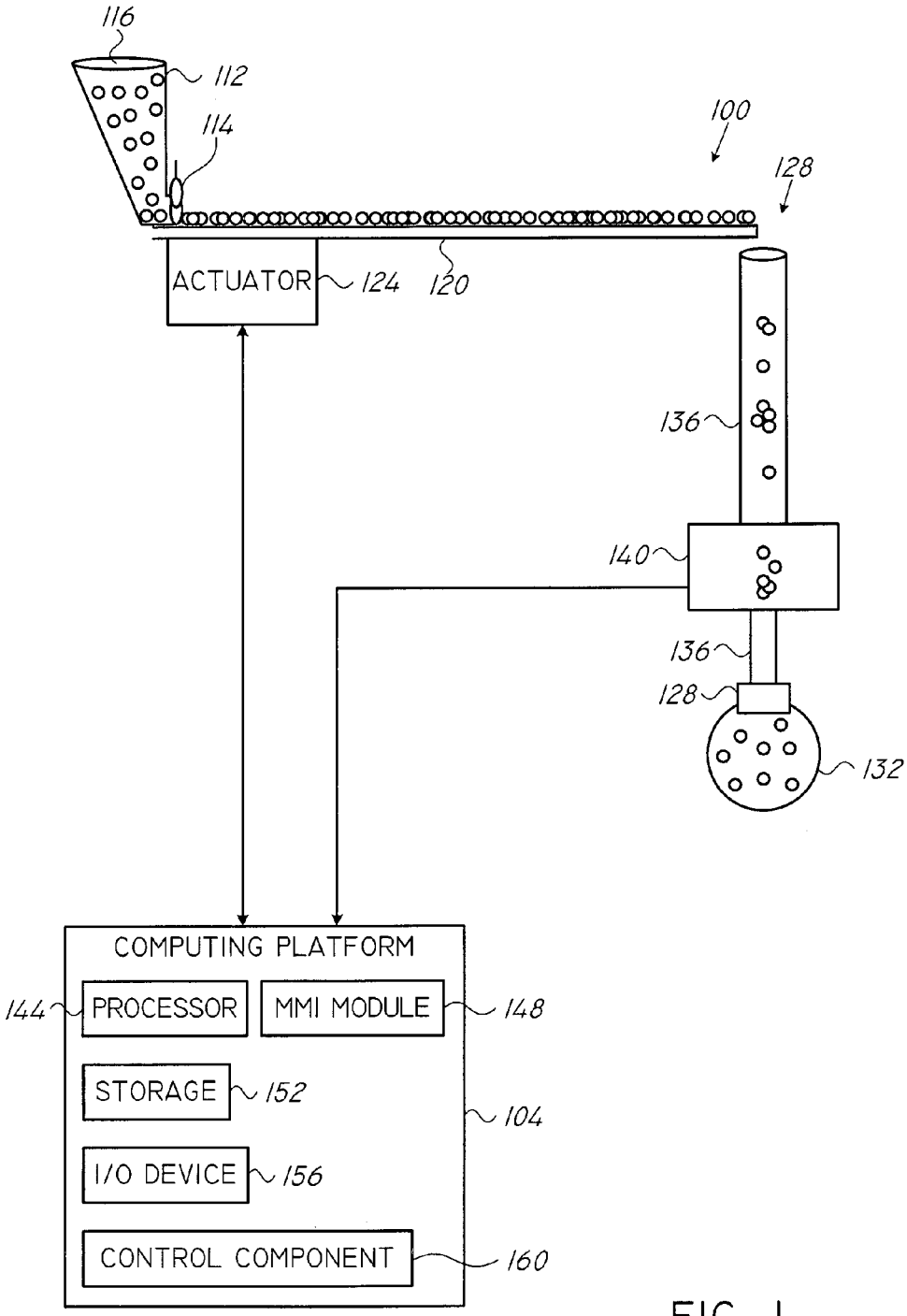
FIG. 1 shows a schematic illustration of a machine for dispensing items, in accordance with some exemplary embodiments of the invention.

The following description relates to rapid, accurate and efficient dispensing of predetermined quantities of discrete items, such as seeds, gems, medicinal pills, candies or the like.

One technical problem addressed by the disclosed method and apparatus relates to a situation in which it is required to dispense items from a container into separate packages, each package containing the same predetermined number of items. The dispensing has to be done at high accuracy, such that no package contains less than the predetermined number of elements so as to avoid customer dissatisfaction and complaints. On the other hand, packages containing more than the predetermined number should be rare, thus avoiding waste and financial losses.

One technical solution is the provisioning of an apparatus and method for dispensing a predetermined number of items.

The apparatus may include a feeder such as a hopper which can contain a large amount of the items which are to be dispensed. The hopper releases the items onto a conveyor activated by an actuator, the actuator controlled by a computing platform. The conveyor may be a conveyor belt, a vibrating conveyor, a vibrating chute, a chute having changing inclination, or any similar means for transporting items along a path. In some embodiments, the items are released from the feeder in a free manner, such that multiple items can be released simultaneously or with minimal time difference, so that a second item begins to release before a first item has been fully released.

The conveyor moves the items from the feeder to a counting area. In some embodiments, the counting area is placed below the end of the conveyor, such that the items are being counted by a counting mechanism while they are falling off the conveyor into a container being filled.

In some embodiments, excluding incidental acceleration of the conveyor when started and deceleration when stopped, the actuator moves the conveyor at constant characteristics, such as speed, vibration frequency, vibration amplitude, chute inclination, and/or the like.

The items are being counted as they fall into the container, and once at least a predetermined number of items have fallen into the container, the conveyor is stopped. In some embodiments, the predetermined number is an undershoot, i.e., smaller than the quantity of items required to be finally dispensed, since it is taken into account that after the conveyor has stopped, one or more items may still fall off its end through the counting area into the container by virtue of inertial forces. The item(s) falling after the conveyor has stopped are counted as well, and the total number of items in the container is determined.

In an embodiment, the system may be configured such that even with the inertial fall, the total number of dispensed items is in almost all cases still smaller than the final required number. In these cases, the control system re-activates the conveyor in one or more pulses, as necessary, so that additional items fall off the conveyor and complete the final number.

A pulse relates to a short activation, in which the conveyor operates at its steady speed (or other characteristic) for a short time period. Some pulses may be even so short, o that the conveyor does not even manage reach its previous, steady speed. Typically, a pulse may last a fraction of a second, and causes a few items, such as, for example, 1-10 items, to fall off the conveyor.

The accumulative number of dispensed items is determined after each pulse, so as to determine whether additional pulses are required. Once the number of dispensed items has been reached (or exceeded) the number of required items, the container is removed, and a new container is placed and filled in the same manner.

The method and apparatus may require calibration for each type of dispensing task. The calibration may depend on the characteristics of the dispensed items, for example size, shape, weight, friction coefficient against the conveyor and/or the like. The calibration also depends on the operation parameters of the apparatus, such as minimal or maximal speed, acceleration and deceleration speed, physical dimensions and/or the like.

Calibration comprises determining one or more parameters related to the activation of the apparatus, such as the rate at which the items are dispensed from the hopper onto the conveyor, the initial length of time for which the control system activates the conveyor so as to dispense most of the required quantity, and the duration of pulse required to complete dispensing of the predetermined quantity. In some embodiments, the length of the pulse may depend on the number of items still missing in a container. For example, if one or two items are missing, the apparatus may be calibrated to activate the conveyor for one 100 millisecond pulse. However, if 20 items are missing, the pulse length may be determined to be 500 milliseconds, after which a few items may still be missing, thus requiring another pulse. Naturally, these exemplary values may change depending on the type of dispensed items and/or the operation parameters of the apparatus.

In some embodiments, in which the conveyor may assume different characteristics for each dispensing type (such as speed, vibration rate, vibration amplitude, and/or the like), these characteristics may also be determined during the calibration stage.

In addition to a calibration step which is performed prior to a new type of dispensing task, calibration may also be performed on the fly, while a dispensing task is being executed. After a group of items has finished to dispense, the operating parameters which characterized this group may be used to adjust the parameters for the next group. For example, if the initial calibration had determined that the conveyor should stop 5 items before the final count is reached, but during the task it appears that an overshoot of the final count occurs too often, then the later, on the fly calibration may set the apparatus to stop the conveyor 6 items before the final count. Similarly, other parameters may be adjusted should any deviation from the desired result is detected at some point. This way, especially during long dispensing tasks having a large number of groups to dispense, there is constant control over the dispensing, such that any deviation from the initial calibration is prevented or at least mitigated.

The counting mechanism employed for determining the number of items that have fallen into the container may be implemented in a variety of ways. In some exemplary embodiments, a method and an arrangement can use two or more, for example three light sources arranged on a horizontal cut through the falling area of the items. A photoelectric sensor is located against each light source so that when the light source emits light and no object is falling, essentially all the cells in the sensor are illuminated. In some embodiments, the light sources emit light in non-perpendicular direction to one another, for example at 60° or 120° to each other—a configuration which may have geometric advantage when analyzing the resulting snapshots. When one or more objects are falling, depending on their respective location, one or more dark areas are detected on one or more of the sensors. The number of objects whose shadows create the dark areas on a sensor can be determined using image analysis techniques. However, for each single sensor, this number may be erroneous since one or more falling items may hide, fully or partially, one or more other falling items. This is typical when two or more of the items fall with at least some degree of horizontal parallelism. Therefore, multiple light sources and multiple sensors are used. In some embodiments, the number of items may be determined to be the maximal number of items determined for any of the sensors. In other embodiments, the number of items may be determined to be the number of items detected by a majority of the sensors. The actual method employed for determining the number of items may depend on factors such as the size and shape of the items, the frequency at which the dark areas of the sensors are analyzed, or others. Said frequency can also be determined during the calibration stage detailed above.

One technical effect of the disclosed subject matter is providing a method and apparatus for dispensing a predetermined number of items into a container, with high accuracy so that on close to 100% of the cases, the package contains exactly the required number, and the task is performed at high efficiency so that the available resources are utilized well.

Reference is now made to FIG. 1, which shows a schematic illustration of an apparatus for providing for dispensing predetermined number of items at high accuracy and high efficiency.

The apparatus comprises a machine 100 communicating with and receiving control commands from a computing platform 104. Machine 100 comprises a counting mechanism 140 which provides information to computing platform 104, upon which control commands may be provided.

Machine 100 comprises a container, such as a hopper 112, which contains a multiplicity of items 116 to be dispensed into containers. Each container, such as container 132, is to contain a predetermined number of items 116.

Hopper 112, shown here as one example of an item container, may comprise a gate 114. Raising or lowering gate 114 limits the number of items 116 being dispensed from hopper 112 onto conveyor 120. In some embodiments, the level of gate 114 is adjusted such that multiple items 116 can be dispensed onto conveyor 120 simultaneously or at partially overlapping time frames, so that there may be no time gap between the time frames at which two consecutive items exit hopper 112. Handling multiple items concurrently provides for fast dispensing and high yield of the method and apparatus.

Conveyor 120 may be a conveyor belt, a vibrating chute, a chute having variable inclination angle or the like. Optionally, conveyor 120 is of a form (hereinafter "parallel transport conveyor") which enables transporting multiple items at least partially in parallel, in a direction orthogonal to the transport direction.

Conveyor 120 is controlled by actuator 124, which receives commands from computing platform 104. Actuator 124 may operated by electrical current, hydraulic fluid pressure, pneumatic pressure or any other energy source, and converts the energy into some kind of motion applied to conveyor 120.

The functionality of actuator 124 depends on the nature of conveyor 120. For example, if conveyor 120 is a conveyor belt, then actuator 124 drives or stops the belt; if conveyor 120 is a vibratory chute then actuator 124 starts or stops a vibration engine; if conveyor 120 is a variable inclination chute then actuator 124 lowers or raises one side of the chute, or the like.

Items 116 proceed along or with conveyor 120 when operated, until the conveyor's end 128. At end 128, the items fall into container 132. In some embodiments, a hollow structure such as but not limited to a cylindrical pipe 136 goes from end 128 or the vicinity thereof, to container 132 or the vicinity thereof. Thus, pipe 136 can be connected to any of end 128, container 132, both, or none. In other embodiments, pipe 136 may be eliminated, so that the items fall freely rather than within a limited space. In most situations where items are placed freely on conveyor 120, most of the items at least partially overlap in a direction orthogonal to the moving direction of conveyor 120. In other words, items may be randomly arranged in layers, in parallel files and/or the like. This results in faster dispensing and a higher yield of the conveyor.

The falling items pass through counting mechanism 140 which may be integrated into pipe 136. Alternatively, pipe 136 can be comprised of two parts, one part going from end 128 to counting mechanism 140, and the other part going from counting mechanism 140 to container 132.

The item count as determined by counting mechanism 140 is transferred to computing platform 104.

Counting mechanism 140 is further detailed in association with FIG. 3A and FIG. 3B below.

Computing platform 104 may comprises a processor 144. Processor 144 may be any Central Processing Unit (CPU), a microprocessor, an electronic circuit, an Integrated Circuit (IC) or the like. Alternatively, computing platform can be implemented as hardware or configurable hardware such as field programmable gate array (FPGA) or application specific integrated circuit (ASIC). In yet other alternatives, processor 144 can be implemented as firmware written for or ported to a specific processor such as digital signal processor (DSP) or microcontrollers. Processor 144 may be used for performing mathematical, logical or any other instructions required by computing platform 104 or any of it subcomponents.

In some embodiments, computing platform 104 may comprise an MMI (man-machine interface) module 148. MMI module 148 may be utilized for receiving input or providing output to and from machine 100, counting mechanism 140, or a user, for example receiving specific user commands or parameters related to calibrating and operating the apparatus, storing and retrieving information, providing output for analyzing performance of the apparatus, or the like.

In some exemplary embodiments, computing platform 104 may comprise one or more storage devices such as storage device 152. Storage device 152 may be non-transitory (non-volatile) or transitory (volatile). For example, storage device 152 can be a Flash disk, a Random Access Memory (RAM), a memory chip, an optical storage device such as a CD, a DVD, or a laser disk; a magnetic storage device such as a tape, a hard disk, storage area network (SAN), a network attached storage (NAS), or others; a semiconductor storage device such as Flash device, memory stick, or the like. In some exemplary embodiments, storage device 152 may retain program code of control component 160 detailed below operative to cause processor 144 to perform acts associated with any of the steps of FIG. 2 detailed below, displaying information to the user, or the like. Storage device 152 may also retain information such as calibration results to be used when operating the machine for a particular type of dispensing task, number of finished containers, the number of items in each container, or the like.

Computing platform 104 may further comprise or be associated with one or more Input/Output (I/O) devices 156 such as a terminal, a display, a keyboard, an input device or the like, to interact with the system, to provide instructions for calibrating the machine or the like.

Computing platform 104 may execute control component 160 for determining and generating control commands to be provided to actuator 124, optionally during calibration, and optionally during operation, for example in accordance with counts received from counting mechanism 140. Control component 160 can be implemented as one or more sets of interrelated computer program instructions, which may be developed using any programming language and under any development environment. The computer program instructions may be stored on storage 152 and provided to processor 144 or any other programmable processing apparatus to produce a machine, such that the instructions, which execute via the processor, create means for implementing the functions specified in the flowcharts or block diagrams. The computer program instructions may also be stored on a computer-readable non-transitory medium to produce an article of manufacture. The steps performed by control component 160 are further detailed in association with FIG. 2 below.

It will be appreciated that computing platform 104 can be provided remotely from machine 100, as part of machine 100, or in any combination thereof.

Figure 2A:
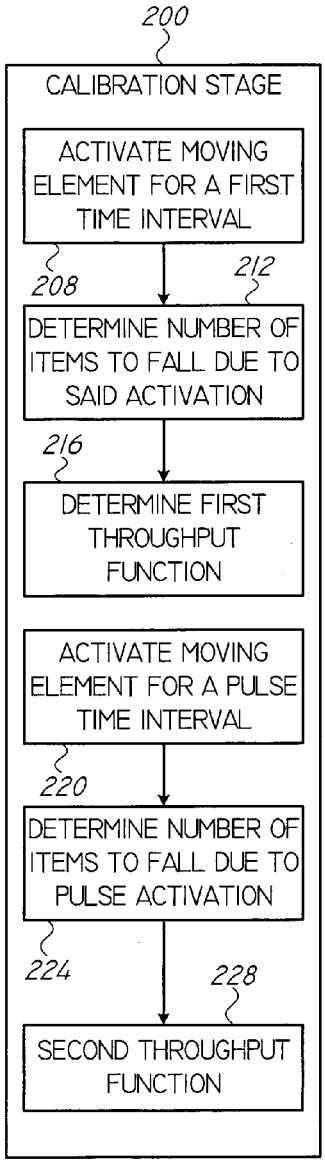
FIG. 2A is a flowchart of steps in a method for calibrating a dispensing machine, in accordance with some exemplary embodiments of the invention.
Figure 2B:
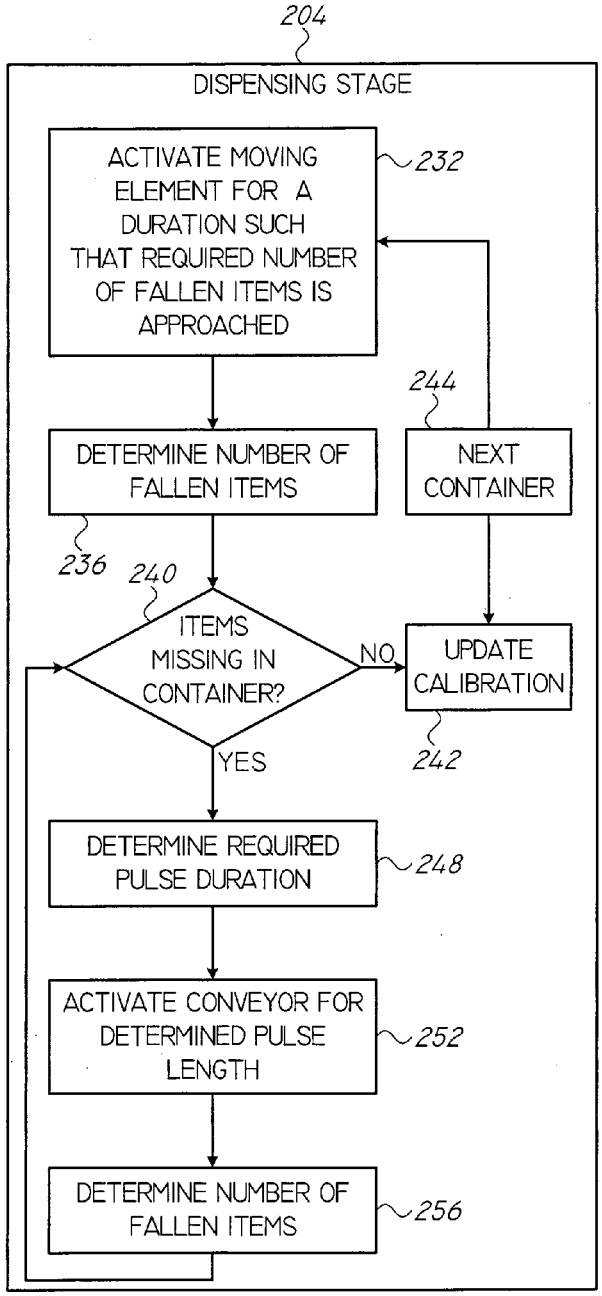
FIG. 2B is a flowchart of steps in a method for operating a dispensing machine, in accordance with some exemplary embodiments of the invention.

Referring now to FIGS. 2A and 2B, showing a flowchart of steps in methods for calibrating and operating a dispensing machine, such as the one shown in FIG. 1, to provide high accuracy and high efficiency dispensing of items, thus yielding high throughput.

FIG. 2A shows a flowchart of steps in an embodiment of a calibrating stage 200 of a dispensing machine.

On step 208, the conveyor is activated for a first duration. In some embodiments, the first time interval is long enough so as to reach substantially uniform rate of falling items, after the initial, incidental acceleration period (which typically lasts a fraction of a second) of the conveyor 120 has been completed.

On step 212, the number of items that have fallen into the container is determined. The fallen items include also the items that have fallen due to inertial forces after the conveyor has stopped. It will be appreciated that step 212 can be performed at least partially concurrently with step 208, since items may be counted as they fall, and/or after the conveyor has stopped.

On step 216, a first function is determined, which relates to the throughput of the system during activation, and associates a number of items falling during and due to the operation of the conveyor with the time period for which it is required to operate the conveyor. The first function may be described analytically, as a look-up table, as a part-wise function or in any other manner. It will be appreciated that the first function may or may not be substantially linear, wherein the non-linearity may be mainly due to the short, incidental acceleration and deceleration periods occurring when activating and stopping the conveyor.

On step 220, the conveyor is activated and operated for a second time interval, referred to as a pulse time interval, which is substantially shorter than the first time interval, typically lasting fractions of a second but optionally, in some embodiments, more than that. On step 224, the number of items to have fallen during and due to said operation is determined similarly to step 212 above. A pulse may relate to a short time interval in which the conveyor operates at its steady speed (or other characteristic) for a time period which is relatively short.

Steps 220 and 224 may be repeated one or more times, since the non-linearity in the throughput when activating the conveyor for short periods of time may be high due to the incidental acceleration and deceleration periods of the machine which are long relatively to the total pulse time.

On step 228, a second function is determined, which relates to the throughput of the system in pulse activations. The function associates a number of items falling during and due to the activation of the conveyor with the time period for which it is required to activate the conveyor. The function may be described analytically, as a look-up table as a part-wise function or in any other manner.

In some embodiments, the first and second functions can be determined as a single, possibly part-wise, function.

The first and second functions may be determined upon multiple activations rather than a single activation each. Thus, the functions may be determined statistically while optionally employing analytical methods.

In some embodiments, the first and second functions are determined and later used when the conveyor operates under constant characteristics, excluding on the acceleration and deceleration times, such as speed, vibration frequency, vibration amplitude, or the like.

Determining the first function, comprising steps 208, 212 and 216, and determining the second function, comprising steps 220, 224 and 228, can be performed in reverse order.

It will also be appreciated that the first and second functions may be item- and setting-dependent, i.e., dispensing different items may yield different functions. In addition, other parameters of the machine may be determined, such as the conveyor speed, frequency, the height of the hopper gate, or the like.

Reference is now made to FIG. 2B, which shows a flowchart of steps in an embodiment of a dispensing stage of a dispensing machine.

On step 232, the conveyor is activated for a period of time determined such that the number of items falling due to activation approaches the number of items it is required to dispense in each container. The duration is determined in accordance with the first throughput function determined on step 216 of the calibration stage. In some embodiments, the period of time is determined such that in the majority of cases, the container will contain less than the required number of items. The reasoning for that is that it is generally more desirable, in this first operation of the conveyor, to have fewer items, which is correctable by adding items, than to have too many items dispensed.

On step 236, the number of items that have fallen into the container is determined. The number of items also includes the items that have fallen due to inertial forces after the conveyor has stopped. It will be appreciated that in some embodiments the items are counted as they fall, which happens when the conveyor is in motion and some time afterwards.

On step 240, it is determined whether items are still missing in the container to complete the entire quantity that has to be dispensed.

If no items are missing, which may be a rare occasion, then on optional step 242, the throughput functions or parameters thereof as set on calibration steps 200, such as the values of particular points in the throughput functions, are updated based on the number of items that have fallen during the initial operation and the one or more pulses. Similarly, if the number of missing items becomes, in time, lower or higher than the number earlier set in the calibration step or in previous groups dispensed, the values of particular points in the throughput functions, are updated based on the number of items that have fallen during the initial operation and the one or more pulses. The updated parameters may be employed when dispensing further groups of items or in later activations. It will be appreciated that the on-the-fly update of the calibration parameters can be performed after dispensing items into one container, after a number of containers have been dispensed, after a full dispensing task was completed, or the like. Repeatedly updating the functions or parameters enhances the accuracy and thus the throughput of the method and apparatus.

Whether the calibration parameters have been updated on the fly or not, the container is removed, and the next container is placed on step 244.

If items are still missing, then on step 248, the required duration is determined for a pulse length, such that the items that will fall due to the pulse will approach or complete the required number of items. The duration is determined in accordance with the second throughput function determined on step 228 on the calibration stage.

In some embodiments, if the number or percentage of items missing in the container exceeds a predetermined value, for example more than 10% or 10 items of the items are missing, the pulse length may be determined such that the total number of fallen items after the pulse may still not complete the required number in many of the cases, and another pulse may be required, which may provide higher accuracy. Namely, if too many items are missing, then a single, long pulse may be inaccurate and inferior to a number of shorter pulses. If, however, the number of missing items is lower than the threshold, then the pulse length may be determined such that the total number of items after the pulse will equal the required number:

In alternative embodiments, only pulses of one or more predetermined lengths may be enabled, such that if items are missing from the container, one of the predetermined lengths can be selected. If only one such predetermined length is enabled, step 248 can be omitted.

Thus, on step 252 the conveyor may be activated for the determined or predetermined pulse length.

On step 256 the number of fallen items is determined similarly to step 236 above, and control returns to step 240.

Depending on the usage and nature of the items to be dispensed, in some embodiments, a single activation of the conveyor would be enough to ensure that in large enough percentage of the cases, the number of dispensed items is within satisfactory range from the required number. If, however, greater accuracy is required, then one or more pulses would be required to achieve the goal so that overshooting is as rare as possible. Overshooting, in general, may be related to the number of items that fall simultaneously into pipe 136 (FIG. 1). The width and/or structure of conveyor 120 may be chosen so as to limit the number of items falling simultaneously into pipe 136, for example the number may be limited to 3 items at most. In different embodiments, depending on the type and/or size of the items, the number of simultaneously-falling items which is limited by the width and/or structure of the conveyor may be different.

Figure 3A:
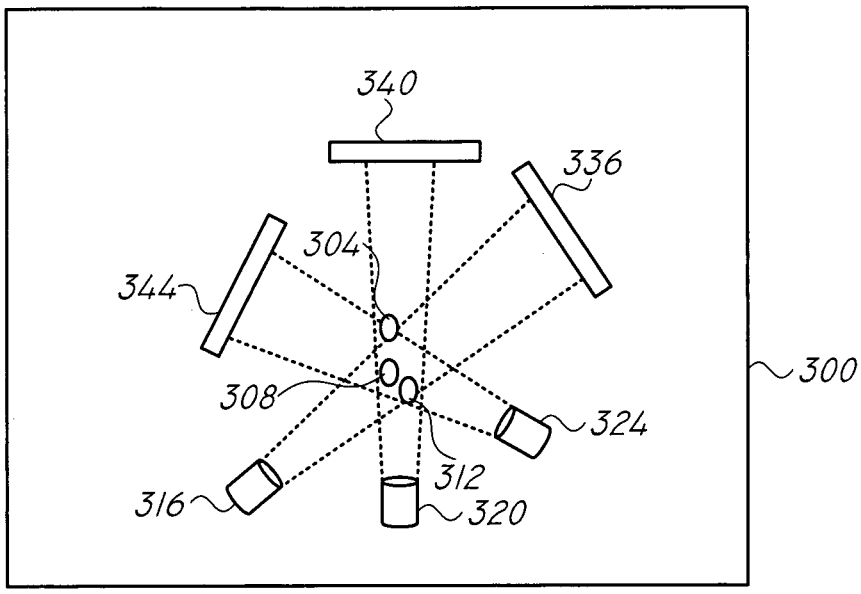
FIG. 3A is an exemplary arrangement of an optical arrangement of a counting mechanism, in accordance with some exemplary embodiments of the invention.
Figure 3B:
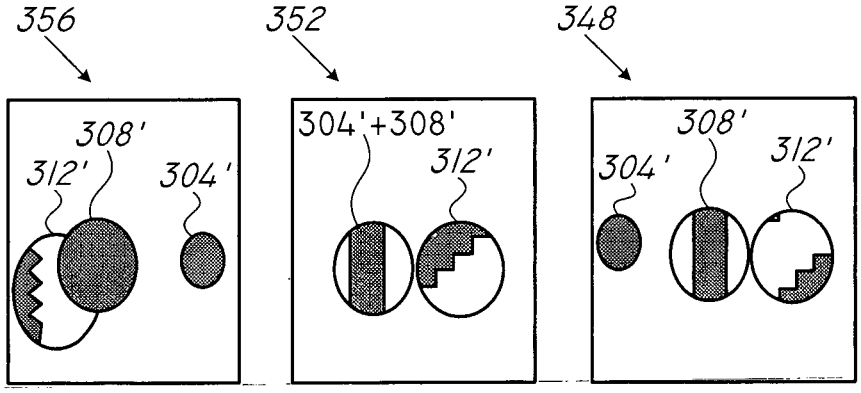
FIG. 3B shows exemplary snapshots of photo detectors of the counting mechanism, in accordance with some exemplary embodiments of the invention.

Reference is now made to FIG. 3A and FIG. 3B, showing an embodiment of counting mechanism 140 of FIG. 1 and its mode of operation.

FIG. 3A shows an exemplary embodiment of a counting mechanism 140. The mechanism comprises an arrangement of light sources and photo detectors designed for counting falling items. The items may be falling freely or inside a bounded space such as cylindrical pipe 136 of FIG. 1.

The arrangement can be arranged inside the pipe, between two disconnected parts of a pipe or around the falling area of the items.

The arrangement comprises one or more, for example three sources of electromagnetic energy 316, 320 and 324 such as laser diodes or other, and three receptors 336, 340, and 344 such as photo detectors sensitive to light or another electromagnetic energy. The sources and receptors are all located surrounding the falling area of the items; such as items 304, 308 and 312, and are substantially on one plane which is substantially orthogonal to the falling direction.

In some embodiments collimated light sources may be used, while in other embodiments non-collimated light sources may be preferred.

In some embodiments, sources 316, 320 and 324 may be arranged so that the energy is emitted from two or more of them in perpendicular directions. In other embodiments, all sources are arranged such that no two of them are perpendicular. For example, three sources can be arranged at angles of 60° as shown in FIG. 3A, or 120° to one another.

It will be appreciated that light sources and photo detectors are exemplary only, and different technologies may be used for sensing the presence of objects.

When the dispensing apparatus is operated, each source emits energy which is detected by the sensor located against it. Thus, the energy emitted by each of sources 316, 320 and 324 is detected by a sensor located opposite to the source, e.g., sensors 336, 340 and 344, respectively.

When one or more items such as items 304, 308, 312 fall off end 128 of conveyor 120 into container 132, the elements pass through counting mechanism 140, and sensed by on one or more of the sensors.

In some embodiments, when light energy is emitted and sensed, light sources 316, 320 and 324 emit continuous light, and photo detectors 336, 340 and 344 are sampled periodically. In other embodiments, sources 316, 320 and 324 emit bursts of light and 336, 340 and 344 are sampled respectively. The frequency of sampling photo detectors 336, 340 and 344 depends on the velocity of the falling items which generally depends on the distance between falling end 128 and counting mechanism 140, dictating how much gravitational acceleration has been achieved so far. Photo detectors 336, 340 and 344 have to be sampled at least once during each time window having duration equal to the time it takes an item to pass through the sensing area, such as through the light beams of sources 316, 320 and 324. Thus, it is guaranteed that each falling item will be captured at least once during the time it falls through viewing mechanism 140. However, if the sampling frequency is higher, then the same item may appear in multiple snapshots and may be counted more than once. This can be substantially corrected by discarding, using image processing techniques, items that appear close to the top of one snapshot and close to the bottom of the next snapshot.

Therefore, if it takes an item T milliseconds to fall through the light beams of light sources 316, 320 and 324, the snapshots should be taken substantially every T milliseconds. In alternative embodiments, photo detectors 336, 340 and 344 may be implemented as CCD line detectors operating continuously at line frequencies of between about 5 MHz and about 10 MHz, wherein the images are constructed and analyzed from the line scans.

Figure 4:
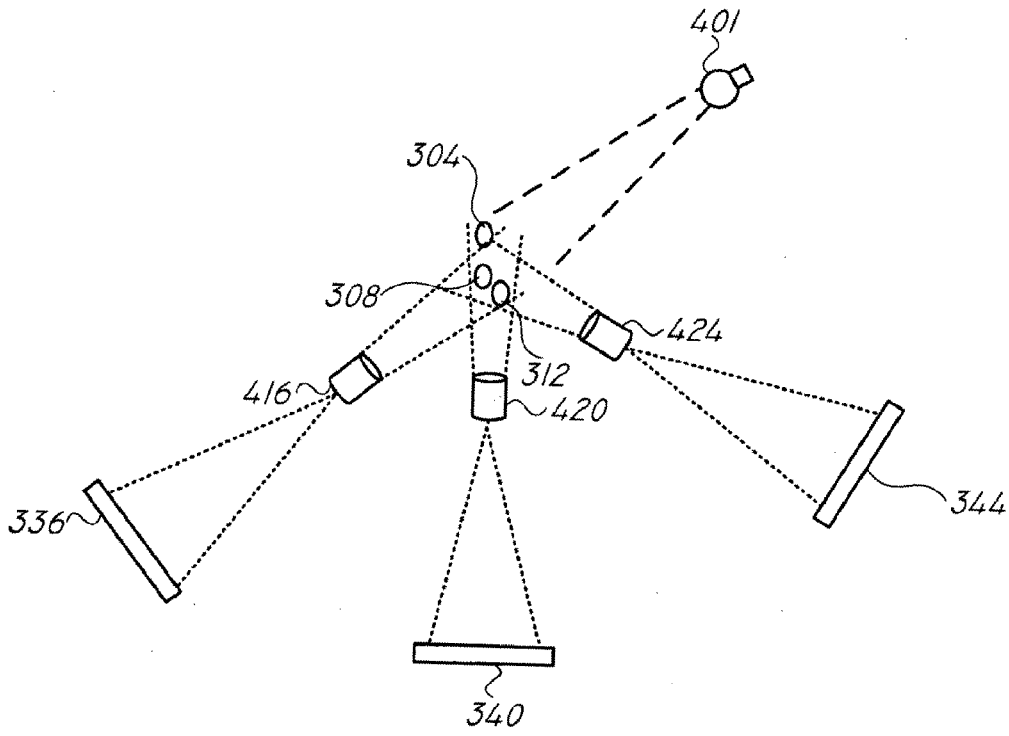
FIG. 4 is an exemplary optical arrangement of a counting mechanism with incoherent light, in accordance with some exemplary embodiments of the invention.

Referring now to FIG. 4, showing an alternative embodiment to FIG. 3A, in which a light source 401 provides incoherent (optionally white) light. The light is reflected from items 304, 308 and 312 and is converged by lenses, such as lenses 416, 420 and 424, onto detectors 336, 340 and 344, respectively.

It will be appreciated that the counting mechanism can comprise additional components, such as a cleaning mechanism for avoid obstructions in any of the viewings connecting a source and a sensor. The cleaning mechanism can work, for example, by blowing air at high pressure, or the like.

Referring now to FIG. 3B, showing an example of three snapshots 348, 352 and 356, taken from sensors 336, 340 and 344, respectively, when items 304, 308 and 312 are falling through the counting mechanism. The shadows of items 304, 308 and 312 are indicated 304', 308' and 312', respectively.

Using image analysis techniques such as edge detection, items can be separated within each snapshot. In the example of FIG. 3B, snapshot 348 shows three distinct items, snapshot 352 shows two distinct items and snapshot 356 also shows three distinct items.

In some embodiments, the number of items falling at a specific time period may be determined as the maximal number of items shown on any of the snapshots. In the example of FIG. 3B it would thus be determined that three items were falling, as seen in snapshot 348 or 356. In other exemplary embodiments, the number of falling items can be determined as the number of items shown in the majority of snapshots. In the example of FIG. 3B this would also yield a result that three items were falling, as seen in snapshot 348 and 356, while snapshot 352 shows only two items since item 308 is hiding item 304 from the point of view of source 320. It would be appreciated that further methods can be utilized to determine the number of items that were falling at the time the snapshots were taken. It would also be appreciated that different number of sources and sensors can be used.

In some further analysis, image analysis techniques may be used for determining whether a falling item is whole or broken, according to its various projections on the sensors. If this feature is provided, broken items can be either ignored or removed from the item stream so that the container will comprise at least the required number of proper items. Alternatively, the entire packaged unit 132 may be discarded.

In some embodiments, the analyzing of the snapshots and the determining of the number of images is performed by a unit or module which constitutes a part of counting mechanism 140. In other embodiments, the snapshots may be transferred to computing platform 104 or to any other computing platform for processing and determining the number of falling items.

The above disclosure lays out a method and an apparatus for dispensing items, optionally into containers, such that each container has a predetermined number of items. The method enables high accuracy so that exactly the required number of items is dispensed in high percentage of the cases. In instances where the number of items dispensed is not equal to the exact number required, it is guaranteed that the number of items exceeds and does not drop below the required number. Experimental results have shown that the disclosed method can account for providing the exact number of items in about 99.99% of the cases. The method also enables high efficiency and throughput. Since the items are not required to be provided from the hopper as a single file, more items can pass through the machine in each activation, thus providing higher overall dispensing rate.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular situation, material, step or component to the teachings without departing from the essential scope thereof. Therefore, it is intended that the disclosed subject matter not be limited to the particular embodiment disclosed as the best mode contemplated for carrying out this invention, but only by the claims that follow.

In the description and claims of the application, each of the words "comprise" "include" and "have", and forms thereof, are not necessarily limited to members in a list with which the words may be associated.

What is claimed is:

1. A method for dispensing discrete items into a multiplicity of containers such that each of the multiplicity of containers contains a predetermined number of items, the method comprising:

operating a conveyor such that items placed on the conveyor fall into a container at least partially in parallel, the conveyor activated for a period of time such that less than the predetermined number of items fall into the container;

counting the falling items using a counting mechanism comprising at least three electromagnetic energy sources and at least three receptors, wherein the counting mechanism is arranged such that:

(a) each of the at least three electromagnetic energy sources emits energy in a different direction, and (b) no two of the at least three electromagnetic energy sources emit energy in perpendicular directions;

determining a number of missing items in the container after items have fallen into the container during the operation and due to inertial forces after the operation; and operating the conveyor for a pulse duration.

2. The method of claim 1, further comprising an earlier calibration stage in which the period of time over which the conveyor is activated is determined in accordance with a first function.

3. The method of claim 2, further comprising updating, on the fly, a parameter associated with the first function of the calibration stage.

4. The method of claim 3, further comprising determining the pulse in accordance with a second function.

5. The method of claim 2, further comprising updating, on the fly, a parameter associated with the second function of the calibration stage.

6. The method of claim 2, wherein the conveyor operates with constant characteristics.

7. The method of claim 6, wherein the characteristics are selected from the group consisting of: speed, vibration frequency, vibration amplitude and inclination.

8. The method of claim 1, further comprising determining the pulse duration such that the missing items will fall during the pulse duration or due to inertial forces acting after the pulse duration.

9. The method of claim 1, wherein the conveyor transports the items in a first direction and wherein two or more items are placed on the conveyor such that the items at least partially overlap in a direction orthogonal to the first direction.

10. The method of claim 1, wherein the at least three electromagnetic energy sources and the at least three receptors surround a falling area of the items.

11. The method of claim 10, wherein the at least three electromagnetic energy sources and the at least three receptors are substantially on one plane which is substantially orthogonal to a falling direction of the items.

12. The method of claim 10, wherein the at least three electromagnetic energy sources are arranged at an angle of 60° from one another.

13. The method of claim 10, wherein the at least three electromagnetic energy sources are arranged at an angle of 120° from one another.

14. The method of claim 1, wherein the counting of the falling items comprises determining an amount of items falling during a time window as a maximal number of items shown in snapshots taken from the at least three receptors during the time window.

15. An apparatus for dispensing discrete items into a multiplicity of containers such that each of the multiplicity of containers contains a predetermined number of items, the apparatus comprising:

a conveyor for transporting items from a feeder to a location from which the items fall into the container;

a counting mechanism for counting a number of items that have fallen off the conveyor into the container during operation of the conveyor and due to inertial forces after the operation, wherein the counting mechanism comprises at least three electromagnetic energy sources and at least three receptors, and is arranged such that: (a) each of the at least three electromagnetic energy sources emits energy in a different direction, and (b) no two of the at least three electromagnetic energy sources emit energy in perpendicular directions;

an actuator for operating or stopping the conveyor in accordance with control commands; and a computing platform for receiving a count from the counting mechanism and generating the control commands to be provided to the actuator, the computing platform executing a control component configured to:

generate a first command to the actuator to operate the conveyor for an operation duration, such that less than a required number of items will fall off the conveyor into the container during the operation and due to inertial forces after the operation; determine a number of missing items in the container after items have fallen into the container during the operation and due to inertial forces after the operation; and generate a second command to the actuator to operate the conveyor for a pulse operation duration.

16. The apparatus of claim 15 wherein the control component is further configured to determining the pulse operation duration such that the missing items will fall during the pulse operation duration or due to inertial forces acting after the pulse operation duration.

17. The apparatus of claim 15, wherein the first command is configured to cause the conveyor to operate with constant characteristics.

18. The apparatus of claim 17, wherein the characteristics are selected from the group consisting of: speed, vibration frequency, vibration amplitude and inclination.

19. The apparatus of claim 15, wherein the operation duration is determined in accordance with a first function.

20. The apparatus of claim 15, wherein the pulse operation duration is determined in accordance with a second function.

21. The apparatus of claim 15, wherein the conveyor is configured to transport the items in a first direction and two or more items are placed on the conveyor such that the items at least partially overlap in a direction orthogonal to the first direction.

22. The method of claim 1, wherein the counting of the falling items comprises determining an amount of items falling during a time window as a number of items shown in a majority of snapshots taken from the at least three receptors during the time window.

23. The apparatus of claim 15, wherein the at least three electromagnetic energy sources and the at least three receptors surround a falling area of the items.

24. The apparatus of claim 23, wherein the at least three electromagnetic energy sources and the at least three receptors are substantially on one plane which is substantially orthogonal to a falling direction of the items.

25. The apparatus of claim 23, wherein the at least three electromagnetic energy sources are arranged at an angle of 60° from one another.

26. The apparatus of claim 23, wherein the at least three electromagnetic energy sources are arranged at an angle of 120° from one another.

27. The apparatus of claim 15, wherein the counting mechanism is configured to determine an amount of items falling during a time window as a maximal number of items shown in snapshots taken from the at least three receptors during the time window.

28. The method of claim 15, wherein the counting mechanism is configured to determine an amount of items falling during a time window as a number of items shown in a majority of snapshots taken from the at least three receptors during the time window.

29. A computer program product comprising:

a non-transitory computer readable medium having stored thereof instructions that, when executed by processor, cause the processor to;

generate a first command for an actuator to operate a conveyor for an operation duration, such that less than a required number of items will fall off the conveyor into a container during the operation and due to inertial forces after the operation;

cause a counting mechanism to count the falling items, the counting mechanism comprising at least three electromagnetic energy sources and at least three receptors, wherein the counting mechanism is arranged such that: (a) each of the at least three electromagnetic energy sources emits energy in a different direction, and (b) no two of the at least three electromagnetic energy sources emit energy in perpendicular directions;

determine a number of missing items in the container after items have fallen into the container during the operation and due to inertial forces after the operation; and generate a second command for the actuator to operate the conveyor for the pulse operation duration.

* * * * *